US011071382B2

(12) United States Patent
Cole

(10) Patent No.: US 11,071,382 B2
(45) Date of Patent: Jul. 27, 2021

(54) ADJUSTABLE LEG

(71) Applicant: Howden Joinery Limited, London (GB)

(72) Inventor: James Robert Cole, Barnsley (GB)

(73) Assignee: Howden Joinery Limited, London (GB)

( * ) Notice: Subject to any disclaimer, the term of this patent is extended or adjusted under 35 U.S.C. 154(b) by 0 days.

(21) Appl. No.: 16/315,154

(22) PCT Filed: Jul. 4, 2017

(86) PCT No.: PCT/GB2017/051978
§ 371 (c)(1),
(2) Date: Jan. 3, 2019

(87) PCT Pub. No.: WO2018/007808
PCT Pub. Date: Jan. 11, 2018

(65) Prior Publication Data

US 2020/0008575 A1 Jan. 9, 2020

(30) Foreign Application Priority Data

Jul. 4, 2016 (GB) ..... 1611656
Jun. 14, 2017 (GB) ..... 1709478

(51) Int. Cl.
*A47B 91/02* (2006.01)
*A47B 91/00* (2006.01)

(52) U.S. Cl.
CPC ..... *A47B 91/024* (2013.01); *A47B 91/005* (2013.01)

(58) Field of Classification Search
CPC ..... A47B 91/024; A47B 91/005
(Continued)

(56) References Cited

U.S. PATENT DOCUMENTS 510,691 A * 12/1893 Luethi et al. ..... A47B 91/024 248/188.4
5,641,139 A * 6/1997 Miller ..... A47B 13/021 248/188
(Continued)

FOREIGN PATENT DOCUMENTS

DE 7530741 U 1/1976
DE 29704418 U1 4/1997
(Continued)

OTHER PUBLICATIONS

GB Intellectual Property Office, Patents Act 1977: Search Report under Section 17(5) for Application No. GB1709478.0, dated Dec. 12, 2017, 4 pages.
(Continued)

*Primary Examiner* — Eret C McNichols
*Assistant Examiner* — Michael McDuffie
(74) *Attorney, Agent, or Firm* — Kilpatrick Townsend & Stockton LLP

(57) ABSTRACT

A kit comprising a cabinet base (30), an adjustable leg for supporting a cabinet, the leg comprising: a first component (60) having an attachment structure for attachment to a cabinet and a first threaded element (63) integral with and extending from the attachment structure, the attachment structure comprising at least two lugs (65) projecting away from the first threaded element (63); and a second component (40) comprising a second threaded element (70) threadedly engageable at one end of the second component (40) with the first threaded element (63), a foot (72) located at the opposite end of the second component (40), and a driving formation (73) whereby the second component (40) can be engaged by a tool and driven to rotate, the driving formation (73) being located inboard of the thread of the second threaded element (63); the first and second components (40, 60) being configured so that when they are threadedly
(Continued)

engaged the driving formation (73) is accessible through the first threaded element (63); the cabinet base defining a hole (38) therethrough and a first set of at least two sockets on its underside for receiving respective ones of the lugs (65), the sockets being positioned relative to the hole (38) such that when the leg is attached to the base (30) with the fixing lugs (65) located in the sockets the driving formation (73) is accessible through the hole (38).

22 Claims, 5 Drawing Sheets

(58) Field of Classification Search
USPC ... 248/688, 188, 188.1, 188.2, 188.4, 188.8; 312/140.1, 140.3, 265.5, 351.3, 351.1
See application file for complete search history.

(56) References Cited

U.S. PATENT DOCUMENTS

| | | | | |
|---|---|---|---|---|
| 5,688,287 | A * | 11/1997 | Cline | A47B 91/022 108/154 |
| 7,588,218 | B2 * | 9/2009 | Kim | A47B 91/024 248/176.3 |
| 7,588,386 | B2 * | 9/2009 | Kielczewski | F16B 5/0233 248/188.4 |
| 7,673,845 | B2 * | 3/2010 | Dam | A47B 91/024 248/188.8 |
| 7,780,128 | B2 * | 8/2010 | Walsberg | A47B 91/024 248/188.2 |
| 7,866,614 | B2 * | 1/2011 | Erdmann | A47L 15/4253 248/188.4 |
| 2004/0174105 | A1 * | 9/2004 | Hung | A47B 91/02 312/351.1 |
| 2008/0116330 | A1 * | 5/2008 | Cotto | A47B 91/024 248/188.4 |
| 2009/0184614 | A1 * | 7/2009 | Walsberg | A47B 91/024 312/351.3 |
| 2010/0176256 | A1 * | 7/2010 | Bove | A47B 91/024 248/188.4 |
| 2011/0050064 | A1 * | 3/2011 | Phillips | D06F 39/125 312/351.3 |
| 2011/0187247 | A1 * | 8/2011 | Carter | A47B 46/00 312/246 |
| 2011/0203495 | A1 * | 8/2011 | McLaughlin | A47B 91/024 108/144.11 |
| 2013/0313386 | A1 * | 11/2013 | Adams | F24C 15/086 248/188.4 |
| 2016/0081474 | A1 * | 3/2016 | Basesme | A47B 91/02 248/188.4 |
| 2016/0084430 | A1 * | 3/2016 | Kempf | G01G 23/002 73/431 |

FOREIGN PATENT DOCUMENTS

| | | | |
|---|---|---|---|
| DE | 29703934 | U1 | 6/1997 |
| EP | 0159574 | A2 | 10/1985 |
| KR | 200406052 | Y1 | 1/2006 |
| KR | 200445789 | Y1 | 9/2009 |
| KR | 101391906 | B1 | 5/2014 |
| KR | 101436343 | B1 | 9/2014 |
| KR | 101450601 | B1 | 10/2014 |
| KR | 200476510 | Y1 | 3/2015 |
| WO | 9911160 | A1 | 3/1999 |
| WO | 2015102276 | A1 | 7/2015 |

OTHER PUBLICATIONS

GB Intellectual Property Office, Patents Act 1977: Search Report under Section 17(5) for Application No. GB1611656.8, dated Feb. 15, 2017, 5 pages.

GB Intellectual Property Office, Patents Act 1977: Search Report under Section 17(6) for Application No. GB1709478.0, dated Sep. 6, 2018, 4 pages.

ISA—European Patent Office; International Search Report and Written Opinion for Application No. PCT/GB2017/051978, dated Nov. 20, 2017, 16 pages.

European Application No. 17739656.1 Examination Report Under 94(3), dated Nov. 24, 2020, 4 pages.

* cited by examiner

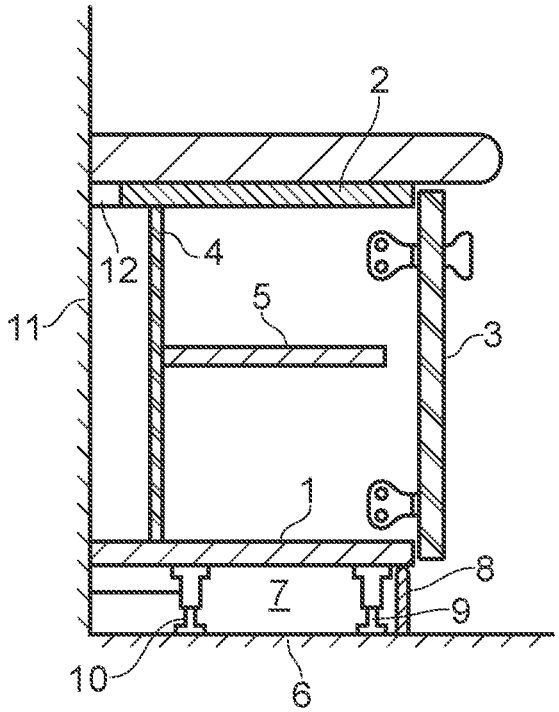
FIG. 1 - PRIOR ART
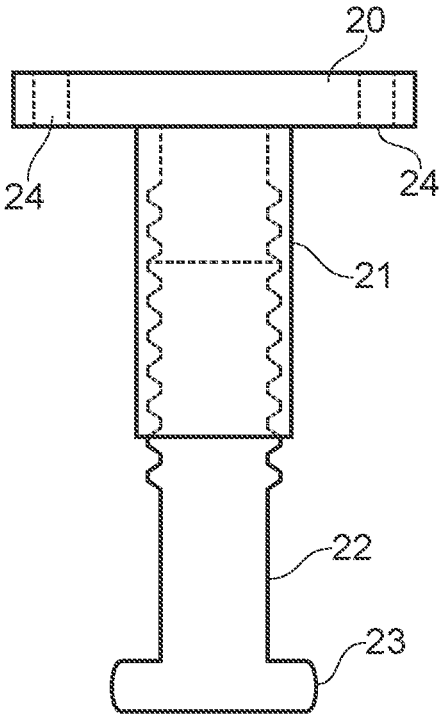
FIG. 2 - PRIOR ART

ADJUSTABLE LEG

CROSS-REFERENCE

This patent application claims the benefit of international patent application PCT/GB2017/051978 filed on Jul. 4, 2017 entitled ADJUSTABLE LEG, which claims the benefit of patent application numbers GB 1611656.8 filed on Jul. 4, 2016 entitled ADJUSTABLE LEG and GB 1709478.0 filed on Jun. 14, 2017 entitled ADJUSTABLE LEG. All patent applications identified above are hereby incorporated by reference.

FIELD

This invention relates to legs, for example for furniture such as cabinets.

BACKGROUND

One example of a cabinet is the conventional kitchen cabinet. FIG. 1 shows a schematic cross-section through such a cabinet. The cabinet comprises a base 1, top/top rails 2, and back panel 4. A shelf 5 can be suspended from fixings in end walls of the cabinet. A door 3 can be hinged off one of the side/end walls. A worktop can be fitted to the top of the cabinet from fixings through or adjacent to the top rails. The base 1 is raised above the floor 6 of the room where the cabinet is installed, leaving a void 7 between the base and the floor. The front of the void is closed by a kickboard or plinth 8. The base is supported off the floor on legs 9, 10. The cabinet can be attached to a wall 11 at the rear of the cabinet by fixings, for example as shown at 12.

FIG. 2 shows the forward leg 9 in more detail. The leg comprises a head plate 20, an upper shaft section 21, a lower shaft section 22 and a foot 23. The head plate can be integral with the upper part of the upper shaft section or a separate part which accepts the upper shaft as a push-in component. The head plate can be screwed or knock-in with an expanding dowel feature to the base 1 of the cabinet through holes 24 so that the upper shaft section extends downwards from the base and into the void 7. The foot is integral with the lower part of the lower shaft section. The upper shaft section and the lower shaft section are threaded together so that when one is rotated relative to the other the distance between the foot and the head plate changes. The foot is configured with a serrated radially outer surface so that it can be gripped by an installer to rotate the lower shaft section. Adjustable legs of this type can be used to level the cabinet on an uneven floor. During installation the head plate of each of the cabinet's legs is attached to the underside of the cabinet base 1 using screws or knock in dowels. Then the installer rotates each of the feet as necessary so as to alter the length of each leg and thereby arrange for the cabinet to be supported on the floor by means of the legs, with the cabinet base in a horizontal attitude.

This arrangement has a number of problems. First, when the installer comes to adjust the rear legs (e.g. leg 10 in FIG. 1) he must reach his arm under the cabinet in order to grip the foot of the leg and turn it. That is inconvenient and increases the time taken to install the cabinets. Second, if the installer needs to shorten the leg to accommodate a particularly prominent part of the floor, it may be necessary to saw the foot off the lower shaft section. With the foot removed it is very difficult to adjust the leg unless a wrench can be engaged on the remainder of the lower shaft section. Third, it can be difficult to level especially heavy cabinets (e.g. tall larder cabinets) in this way. To adjust the leg of a heavy cabinet the installer might have to relieve weight from the leg, e.g. by tilting or jacking the cabinet, to make it easier to manually rotate the foot. This is inconvenient and could be unsafe if it is not done correctly.

SUMMARY

There is a need for an improved form of adjustable leg and/or an improved form of cabinet kit and/or an improved method of assembly.

According to one aspect of the present invention there is provided a kit comprising: a cabinet base; and an adjustable leg for supporting a cabinet, the leg comprising: a first component having an attachment structure for attachment to a cabinet and a first threaded element integral with and extending from the attachment structure, the attachment structure comprising at least two lugs projecting away from the first threaded element; and a second component comprising a second threaded element threadedly engageable at one end of the second component with the first threaded element, a foot located at the opposite end of the second component, and a driving formation whereby the second component can be engaged by a tool and driven to rotate, the driving formation being located inboard of the thread of the second threaded element; the first and second components being configured so that when they are threadedly engaged the driving formation is accessible through the first threaded element; the cabinet base defining (i) a hole therethrough and (ii) a first set of at least two sockets on its underside for receiving respective ones of the lugs, the sockets being positioned relative to the hole such that when the leg is attached to the base with the fixing lugs located in the sockets the driving formation is accessible through the hole.

The sockets may be in the form of blind holes or through-holes. The lugs may be sized to fit snugly or loosely in the sockets.

The kit may comprise cabinet side walls and a cabinet rear wall, the cabinet side walls and the cabinet rear wall being configured for attachment to the cabinet base to form a cabinet carcass.

The cabinet base may be a planar or substantially planar structure. The cabinet base may have an upper surface that is adapted to be substantially horizontal when the cabinet is installed. The upper surface may be flat. The cabinet base may be formed by a layer of composite material having a waterproof layer on its upper surface. The composite material may comprise processed wood: for example, it may be a chipboard or fibreboard. The waterproof layer may be a sheet of polymer material. The waterproof layer may be bonded by adhesive to the composite layer. The markers may be on the lower face of the cabinet base.

In the kit the cabinet side walls and the cabinet rear walls may be unattached to the cabinet base. The side walls, the rear walls and the base may subsequently be assembled to form part or all of a cabinet carcass.

The cabinet side walls and the cabinet rear may each be substantially planar. They may be packaged parallel to and overlying each other in a flat package.

The first component may comprise a bore therethrough, the bore extending along the thread axis of the first threaded element, the driving formation being accessible through at least a portion of the bore when the first component is threadedly engaged in the second component.

The first component may be threadedly engaged in the second component.

The driving formation may be located at the said one end of the second component.

The driving formation may comprise one or more of: a slot-shaped recess, a cross-shaped recess, a hexagonal recess and a hexagonal protrusion.

The second threaded element may be integral with the driving formation.

The foot may comprise a pad that is free to rotate with respect to the second threaded element.

The second component may comprise a grip formation, for example in the form of a wheel, located outboard of the thread of the second threaded element.

The exterior of each of the lugs may be ribbed for resisting removal of the lug from a corresponding hole in the cabinet; for example the said sockets.

The attachment structure may have three such lugs. The cabinet base may be provided with a socket corresponding to each lug whereby the lugs can be used to promote positional registration between the said hole and the driving formation.

The sockets are positioned relative to the hole such that when the leg is attached to the base with the lugs located in the sockets the hole is aligned with the driving formation.

The kit may comprise a further such adjustable leg. The cabinet base may define a further set of sockets on its underside for receiving respective ones of the lugs of the further adjustable leg. The base might define no through-hole through which the driving formation of the second leg is accessible when the further leg is attached to the base with the lugs of the further leg located in the sockets of the further set.

The first adjustable leg and the further adjustable leg may be of identical form.

The cabinet base may have a front; and the sockets of the further set may be closer to the front than the sockets of the first set.

According to a second aspect of the present invention there is provided a kit comprising: a cabinet base; at least two legs, each leg comprising (i) an attachment structure for attachment to the base, the attachment structure having reference markers whereby the position of the attachment structure relative to the base can be distinguished and (ii) an adjustable support structure, the leg being configured such that the length of the adjustable support structure is adjustable by the application of an linearly elongate tool to the adjustable support structure through the attachment structure; the cabinet base: (i) having two sets of markers on one face thereof, each set of the markers being configured so as to collectively designate a single location at which the markers of one of the legs can be aligned with the markers of that set; and (ii) defining a hole therethrough, the hole being located so as to permit an elongate tool to access the adjustable support structure of one of the legs when the markers of that leg are aligned with the markers of one of the sets.

The cabinet base might define no hole therethrough whereby an elongate tool may access the adjustable support structure of the other of the legs when the markers of that leg are aligned with the markers of the other of the sets.

The markers of the said one of the sets may designate a rear leg position and the markers of the said other of the sets may designate a forward leg position, e.g. with respect to the cabinet base as installed or intended or directed to be installed.

The cabinet may be a kitchen cabinet.

According to a third aspect of the present invention there is provided a method of assembling a cabinet kit, the kit comprising a cabinet base having a hole therethrough and an adjustable leg, the adjustable leg having first and second components threadedly connected together and being configured so that a first one of the components can be engaged by a tool passing in a straight line through the other of the components for causing relative rotation of the components; the method comprising: attaching the leg to the base in a location such that the first one of the components can be engaged by a tool passing through the hole in the base; positioning the base in a desired installation location; and adjusting the leg by means of a tool passing through the hole.

The adjusting step may be performed whilst the leg is engaged with a floor.

The kit used in the method may be a kit as set out above.

The first thread element may be rigidly attached to the attachment structure. The second threaded element may be rigidly attached to the driving formation.

The present invention will now be described by way of example with reference to the accompanying drawings. In the drawings:

BRIEF DESCRIPTION OF THE DRAWINGS

FIG. 1 is a cross-section through a conventional kitchen cabinet.

FIG. 2 shows a conventional cabinet leg.

In FIGS. 3 to 7 like parts are designated with the same reference numerals.

DETAILED DESCRIPTION

Figure 3:
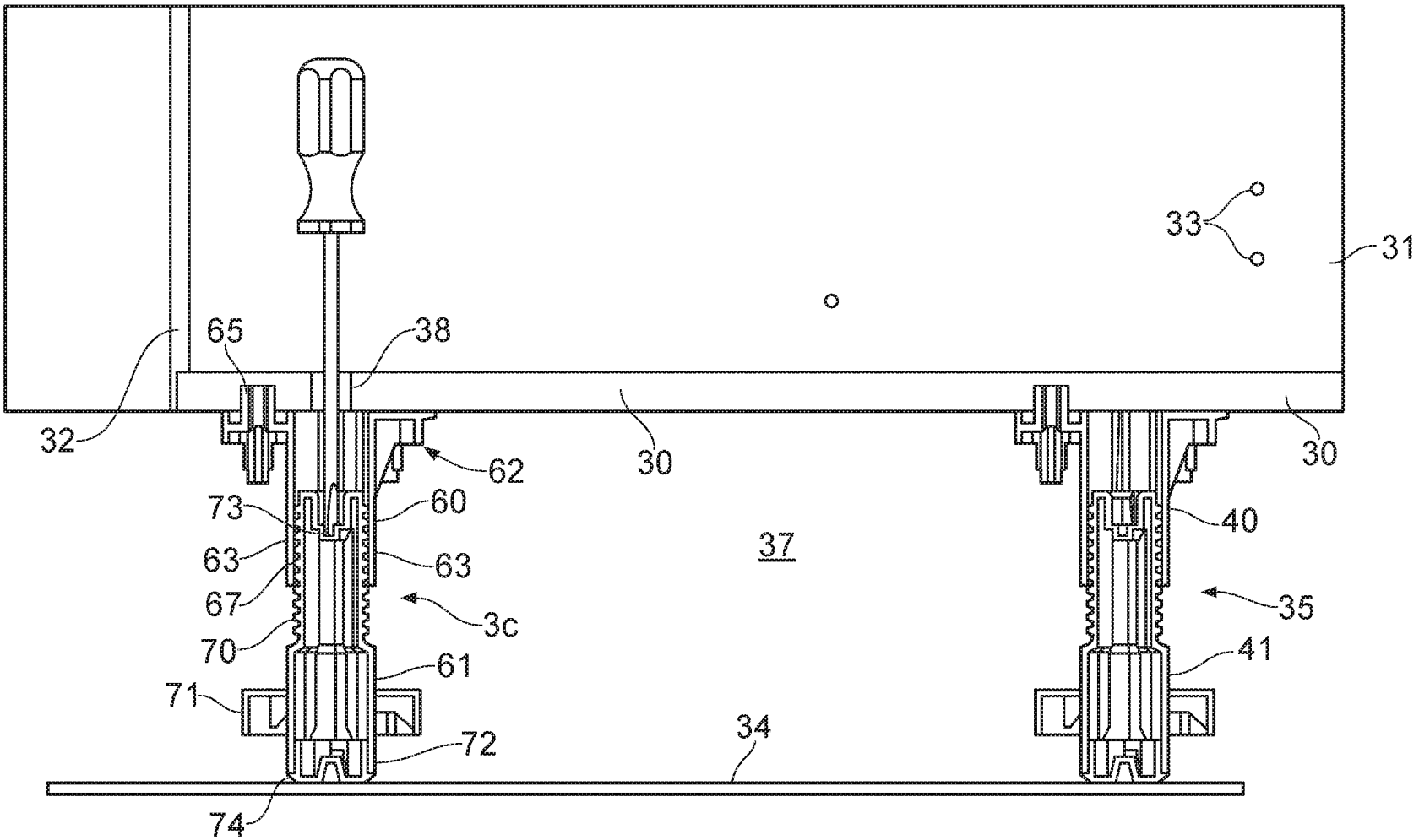
FIG. 3 is a cross-section through the lower part of a kitchen cabinet and front and rear legs.

FIG. 3 shows the lower part of a cabinet whose carcass is generally of the type shown in FIG. 1. The cabinet comprises a base 30, a side wall 31 and a back panel 32. The base 30 and the back panel are shown in cross-section in FIG. 3. The side panel has fixing holes 33 to help in attaching hinges to the side panel to support a cabinet door (not shown). The base 30 and the side wall 31 are formed as rigid panel elements. The back panel 32 is formed as a semi-rigid panel element. The base, side wall and back panel could, for example, be formed of one or more lignocellulosic materials such as chip board, fibre board or hardboard. They could be coated on one or more of their major surfaces with a protective or decorative covering such as a laminate, melamine paper, wood veneer or polymer sheet. The base, the side wall and the back panel could be fixed together with glued wooden dowels, screws, nails or other fixings, adhesive or by means of mechanical interlockings such as tongue and groove joints.

The cabinet is supported on a floor 34 by a front leg 35 and a rear leg 36. The legs are shown in cross-section in FIG. 3. In practice the cabinet could have more legs, for example four legs, so that it can rest stably on the floor. A void 37 is defined between the base 30 of the cabinet and the floor 34. A kickboard or plinth (not shown) can close the front of the void. The kickboard can be clipped to the front leg 35 by clips, for instance by the clips making a resilient snap fitting around the leg.

The complete cabinet carcass would typically comprise the base 30, two side walls, a back panel and a top panel. Optionally the cabinet may have one or more doors, which could be attached to the side walls by hinges, one or more shelves and/or other accessories.

Each leg comprises two major parts: an upper part 40, 60 and a lower part 41, 61. The upper part is rigidly attached to the cabinet. The lower part engages the ground. The lower part is threadedly coupled to the upper part in such a way as to permit the length of the leg to be adjusted by relative rotation of the upper and lower parts about the thread axis. The cabinet will typically have two or more front legs and two or more rear legs. The legs may be arranged in a rectangular pattern when viewed from above.

In this example the front and rear legs are identical, although that is not essential. The legs will be described in more detail with reference to the rear leg.

Figure 5:
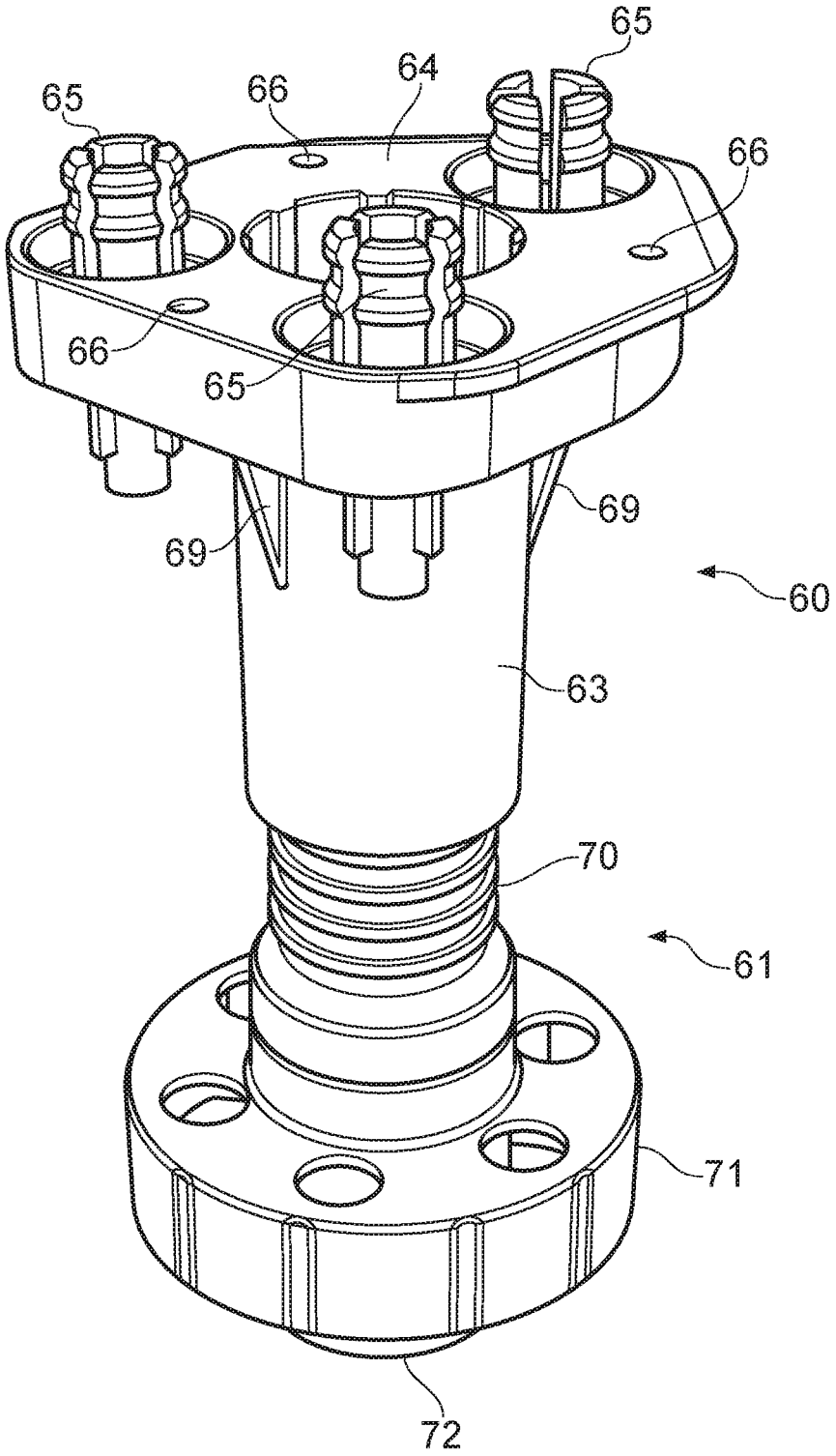
FIG. 5 is an oblique view of a cabinet leg as shown in FIG. 3.
Figure 6:
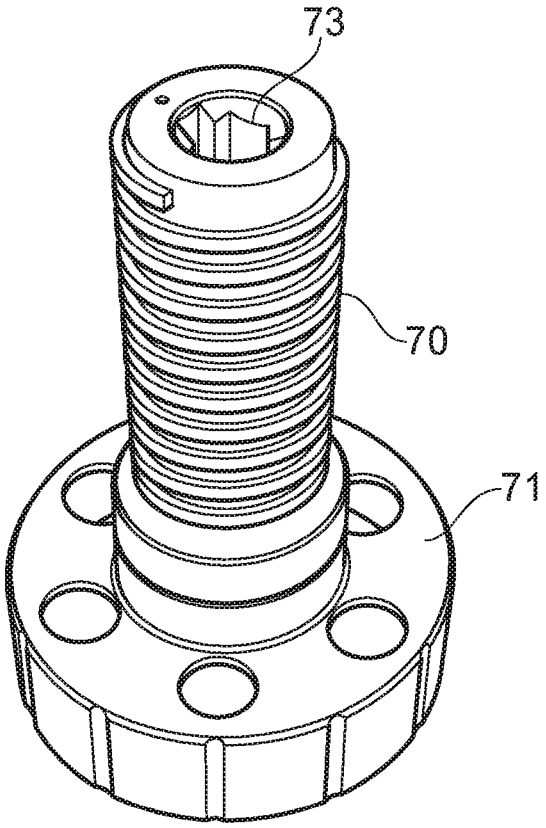
FIG. 6 is an oblique view of a lower part of a leg as shown in FIG. 3.

The upper part 60 of the rear leg comprises a fixing plate shown generally at 62 and a sleeve 63. The fixing plate and the sleeve may be integral with each other. The fixing plate is intended to facilitate the attachment of the upper part of the leg to the base of the cabinet. The fixing plate has a planar mating surface 64 (FIG. 5) which is intended to abut the underside of the base. Extending from the mating surface in the opposite direction to the sleeve 63 are fixing dowels, or more generally lugs, 65. The fixing dowels or lugs can be mated into corresponding holes in the base of the cabinet (see FIG. 3). This assists in forming a secure union between the base of the cabinet and the upper part of the leg. The fixing dowels have ridged or tanged outer formations to resist removal of the dowels from the holes. The fixing dowels or lugs are hollow along their lengths so that corresponding pins can be knocked/pushed through the base and into the dowels or lugs to resist removal. Screws may also be passed though fixing holes 66 in the fixing plate and screwed into the base of the cabinet. The sleeve 63 is positioned relative to the fixing plate so that extends downwardly from the base of the cabinet when the leg is attached to a cabinet in situ. The sleeve comprises an outer wall that is generally circularly cylindrical or in the form of a tube. A helical thread 67 is formed in the interior of the sleeve. The thread may extend through the entirety of the interior length of the sleeve. Alternatively the thread may exist only at the end of the sleeve most distant from the mating surface 64, in which case the remainder of the sleeve may be provided with formations such as radial ribs 68 for helping to stiffen the sleeve. As will be discussed in more detail below, all of the interior of the sleeve, or at least the central part of the interior of the sleeve, is hollow and preferably unobstructed from the end of the upper part 60 at which the fixing plate is located. Webs 69 extend between the fixing plate and the exterior of the sleeve to help maintain the sleeve in a desired attitude relative to the fixing plate. The axis of the thread is preferably perpendicular to the plane of the mating surface, but it could be angled relative to the mating surface.

The lower part 61 of the leg comprises a shaft 70, an adjustment collar 71 and a foot 72. The adjustment collar and the shaft may be integral with each other. The foot may be integral with the adjustment collar. The shaft 70 is externally threaded, the thread being configured such that the shaft 70 can mate threadedly with the interior thread 67 of the sleeve 63. The adjustment collar 71 is disposed about the longitudinal axis of the shaft. The adjustment collar has an uneven outer surface, e.g. having ridges or grooves in it, to facilitate gripping of the collar by a user. Conveniently the adjustment collar has a greater diameter than the shaft 70. The foot is located on the opposite side of the collar to the shaft. The foot is located at the lower extremity of the lower part 61 of the leg. The foot may comprise a ground pad 74 at its lower end. The ground pad may be formed of a material such as nylon which facilitates sliding or rotation of the lower part 61 when it is resting on a floor. The ground plate may be attached to the remainder of the lower part of the leg in such a way that it can rotate freely about the axis of the shaft 70 with respect to the shaft. For example the ground plate may be snap fitted in to the remainder of the lower part 61 of the leg. This can help to reduce resistance to rotation between the leg and the floor when the leg is bearing weight. As will be discussed in more detail below, the lower part 61 of the leg is provided with a driving formation 73 whereby a tool can be engaged with the lower part of the leg to drive it to rotate.

Figure 7:
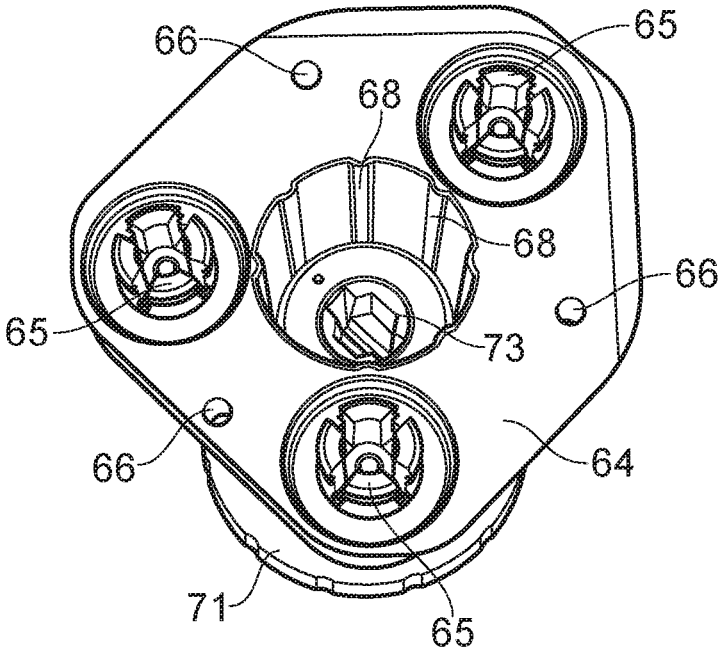
FIG. 7 is an oblique view of a cabinet leg as shown in FIG. 3 when viewed from the top.

The driving formation 73 of the lower part of the leg is a structure that is of non-uniform radius about the longitudinal axis of the shaft 70. The driving formation may, for example be configured to be engaged by a conventional turning tool such as an Allen key, a screwdriver or a spanner. Thus the driving formation may comprise a hexagonal socket, a slot, a cross or a hexagonal boss. Alternatively the formation may be configured to be driven by a tool having a non-conventional head shape. In each case the formation may be centred on and disposed about the longitudinal axis of the shaft 70. As can be seen from FIG. 7, when the lower leg part 61 is threaded into the upper leg part 60, the fact that the interior of the sleeve 63 is open and unobscured from the end of the leg opposite the foot means that the driving formation can be accessed from that end of the leg. As a result, and as shown for leg 36 in FIG. 3, a tool having a straight shaft can be inserted through the upper part 60 of the leg and engaged with the driving formation. This allows the lower part 61 of the leg to be rotated with respect to the upper part of the leg without the lower part of the leg being manually gripped, even when the leg is on the floor and under load. In order to permit the tool to pass into the leg from above, the base 30 of the cabinet is provided with an access hole 38. The access hole passes through the base. This means that the tool can be inserted into the leg from the interior of the cabinet and engaged with the driving formation. The access hole is in predetermined registration with the blind holes in the underside of the base in which the lugs 65 are inserted, so that when the upper part of the leg is attached to the base with the lugs located in their blind holes the access hole is aligned with the driving formation. This arrangement means that an installer does not need to reach into the void under the cabinet to adjust the leg—instead he can insert a tool into the leg from the interior of the cabinet and adjust the leg by means of that tool.

The shaft 70 is arranged so that when the lower leg part 61 is threaded into the upper leg part 60 the driving formation is accessible from through the upper leg part. If the driving formation is recessed in the shaft 70 when viewed from above then the upper end of the shaft 70 is hollow.

The driving formation is preferably located in the threaded part of the shaft 70. The driving formation is preferably located so that in directions perpendicular to the thread axis it is surrounded by the thread. The driving formation is preferably located inboard of the thread. The driving formation is preferably located in the upper half of the shaft 70 (i.e. the longitudinal half furthest from the foot). At least part of the driving formation is preferably located at (e.g. within 10 mm of) the upper end of the shaft 70 (i.e. the end furthest from the foot). If the cabinet is being installed on a particularly uneven floor the installer may need to saw through the lower leg part 61 and remove the foot, or more, from the lower end of that leg part so as to allow it to fit over a prominent part of the floor. When the driving formation is located in the upper section of the lower leg part 61 it can be retained in the shaft even when a lower section of the lower leg part has been removed.

It is especially convenient if the cabinet is provided with through-holes 38 through which the rear cabinet leg(s) can be accessed, because rear legs are more difficult to reach through the void 37. In one arrangement, through-holes 38 are provided for accessing each rear cabinet leg, but no through-holes are provided for accessing each front cabinet leg. Thus the upper surface of the base is intact over the front cabinet leg(s). (See FIG. 3). The front cabinet legs would then be adjusted through the void 37. This means that the floor of the cabinet can be smooth at the front of the cabinet, where it tends to be more frequently accessed by a user. Alternatively, through-holes could be provided for both front legs. The through-holes could be covered by caps when the cabinet has been installed.

The lugs 65 make it easier for an installer to get the through-hole 38 in the cabinet base aligned with the driving formation. When there are two or more lugs, by suitable positioning of the holes into which the fixing lugs are to be inserted, the upper part of the leg can be assured of being in the appropriate location relative to the through-hole when the lugs are inserted in the holes. When there are three or more lugs, by suitable positioning of the holes into which the lugs are to be inserted, the upper part of the leg can be assured of being in a desired orientation about a vertical axis when the lugs are inserted in the holes. If more lugs are provided and there is a snug fit between the lugs and the holes then more force may be required to attach the upper leg part to the cabinet base. Therefore, having exactly two or three such lugs is preferred.

If the lugs 65 are omitted then it could be left to an installer to position a leg under the respective access hole so that the interior of the leg is accessible from through the base. If the leg is to be screwed to the base, e.g. using holes 66, guide marks could be provided on the underside of the base, in registration with the access hole, to indicate to the installer where to insert the screws into the base for proper alignment of the leg with the access hole. The guide marks could be indentations or printed indicia.

When the lugs are in the form of dowels they may be configured to fit snugly into the corresponding holes in the base so as to resist removal.

The pitch of the thread formed in the leg is preferably sufficiently short that when the leg is loaded longitudinally friction in the thread will prevent it from turning under that load.

In the arrangement of FIG. 3, the shaft 70 of the lower leg is relatively broad. This means that the leg as a whole can be relatively stable, especially when the cabinet is loaded. Conveniently the external diameter of the threaded portion of the lower leg is greater than 2.0 times, greater than 2.5 times or greater than 3.0 times the diameter of the driving formation. In this context the driving formation may be defined as the formation having circumferentially-directed walls adapted for engagement with a driving tool, for example a raised or recessed hexagon, slot, star or cross. Preferably the diameter of the lower leg shaft 70 is greater than the diameter of the through hole 38. This can help prevent the leg being inadvertently retracted into the cupboard void. Conveniently the external diameter of the threaded portion of the lower leg is greater than 2.0 times, greater than 2.5 times or greater than 3.0 times the diameter of the through hole 38. The shaft 70 of the leg is hollow. The exterior wall of the shaft carries the male threaded formation. Within that wall is a void. This means that the weight of the leg can be reduced. It is preferred that the walls of the sleeve 63, on whose interior surfaces the female thread is formed, extend in a direction parallel with the thread axis from the region where the female thread is provided to the base-facing upper surface of the leg upper part 62. This means that vertical load can be passed from the lower part of the leg directly on to the lower surface of the base when the leg upper part is installed on the base, and may help to inhibit flexing of the walls in comparison to designs in which those walls span in a direction some extent transverse to the thread axis. Preferably, the walls of the sleeve 63 form a single integral component. Preferably that component is integral with the lugs 65. Preferably the leg has a single threaded engagement between the part of the leg that is or is configured to be fast with the cabinet base (60 in the example of FIG. 3) and the floor-engaging part of the leg (70 in the example of FIG. 3).

The cabinet could be closed with a door, with drawers, could be intended to be left open or could be intended to house an appliance. In the examples given above the leg is used on a kitchen cabinet. The leg could alternatively be used on other furniture, including bedroom and workshop cabinets, on appliances, or for levelling structures such as floors. One or more parts of the cabinet (e.g. the base) may be supplied together with one or more legs as a kit. In the examples given above the leg is installed vertically to support the cabinet. The leg could alternatively be used to space the cabinet in any direction from any adjoining structure.

In the examples given above, the lower part of the leg is inserted into the upper part of the leg. Alternatively the upper part of the leg could carry the male thread and could be inserted into the lower part of the leg which would carry the female thread. If the lower part of the leg carries the female thread, the male thread may be formed on a member that has a longitudinal through-bore through which a driving formation on the lower leg part can be accessed for driving the lower leg part to rotate.

Figure 4:
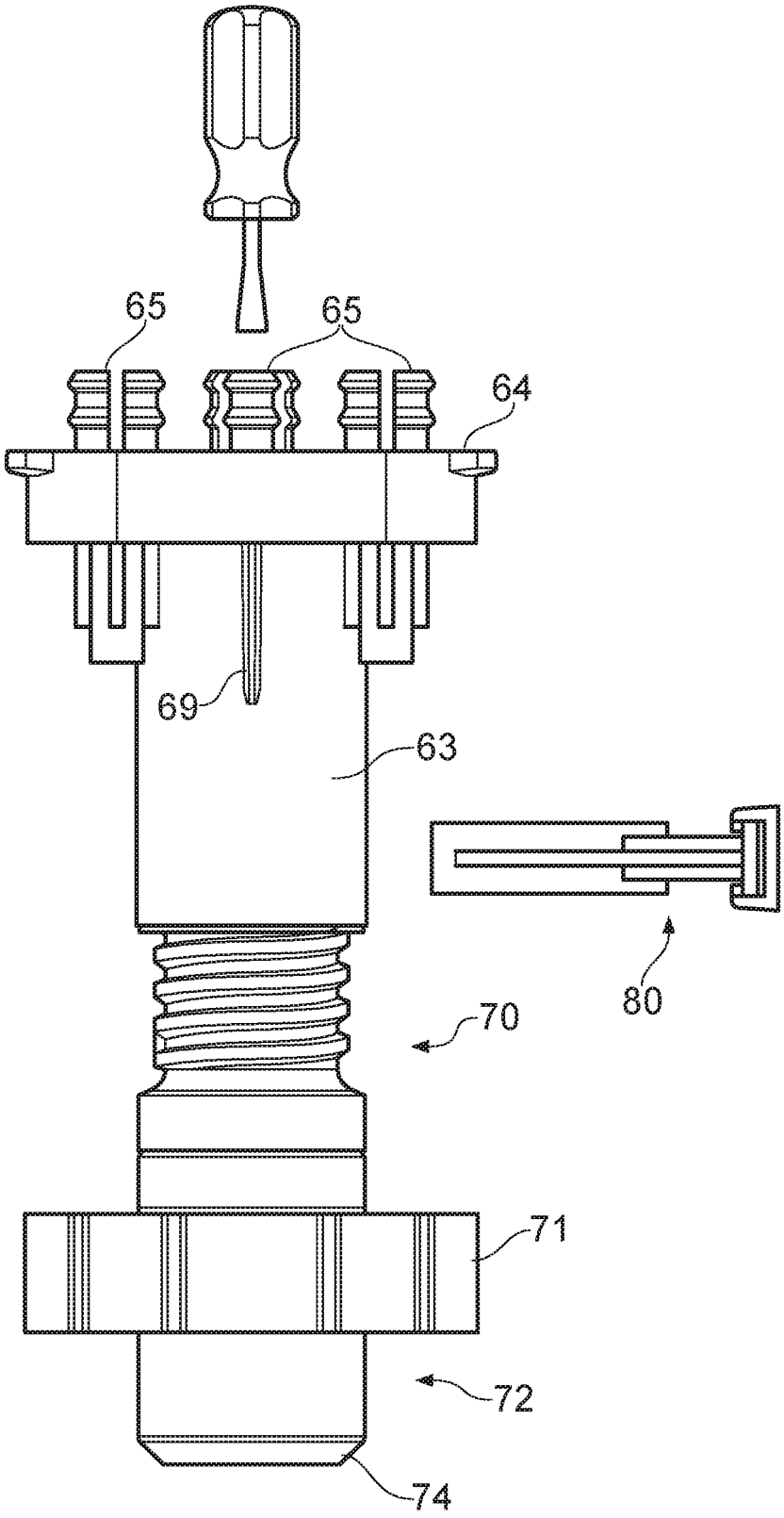
FIG. 4 is a side view of a cabinet leg as shown in FIG. 3.

FIG. 4 shows a clip 80 which can make a snap fit to the leg to hold, for example, a kickboard or plinth in place.

The first and second leg parts may be each formed as respective integral parts, for example by injection moulding, or they may be assembled from sub-parts. The female threaded part, that is sleeve 63 in the arrangement of FIG. 3, may preferably have not more than a single turn of thread. There is preferably not more than one thread crest along any line parallel with the thread axis. This can make it easier to mould the internally threaded part because internal formers defining the interior of the thread can be removed without turning to disengage them from the thread.

The cabinet base may have a front. The front may be distinguished from the rear in the manners known to cabinet assemblers: for example by being fitted on its face with a cosmetic coating such as melamine paper, or by being at the opposite end of the base from an end of the base that is adapted to receive a rear face of the cabinet.

The cabinet may be provided in a kit comprising the base and one or more a first side face, a second side face and a rear face. In kit form the base may be unassembled from one or more of the said faces. The faces may all be of generally planar form. They may be packaged positioned adjacent each other, in a so-called flat pack.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A kit comprising:

a cabinet base; and an adjustable leg for supporting a cabinet, the leg comprising:

a first component having an attachment structure for attachment to a cabinet and a first threaded element integral with and extending from the attachment structure, the attachment structure comprising at least two lugs projecting away from the first threaded element; and a second component comprising a second threaded element threadedly engageable at one end of the second component with the first threaded element, a foot located at the opposite end of the second component, and a driving formation whereby the second component can be engaged by a tool and driven to rotate, the driving formation being located inboard of the thread of the second threaded element, wherein the second threaded element is rigidly attached to the driving formation;

the first and second components being configured so that when they are threadedly engaged the driving formation is accessible through the first threaded element;

the cabinet base defining (i) a hole therethrough and (ii) a first set of at least two sockets on its underside for receiving respective ones of the lugs, the sockets being positioned relative to the hole such that when the leg is attached to the base with the lugs located in the sockets the driving formation is accessible through the hole, and wherein the external diameter of the second threaded element is greater than the diameter of the hole.

2. A kit as claimed in claim 1, wherein the kit comprises cabinet side walls and a cabinet rear wall, the cabinet side walls and the cabinet rear wall being configured for attachment to the cabinet base to form a cabinet carcass.

3. A kit as claimed in claim 2, wherein the cabinet side walls and the cabinet rear walls are unattached to the cabinet base.

4. A kit as claimed in claim 2, wherein the cabinet base, the cabinet side walls and the cabinet rear are each substantially planar and packaged parallel to and overlying each other in a flat package.

5. A kit as claimed in claim 1, wherein the first component comprises a bore therethrough, the bore extending along the thread axis of the first threaded element, the driving formation being accessible through at least a portion of the bore when the first component is threadedly engaged in the second component.

6. A kit as claimed in claim 1, wherein the first component is threadedly engaged in the second component.

7. A kit as claimed in claim 1, wherein the driving formation is located at the said one end of the second component.

8. A kit as claimed in claim 1, wherein the driving formation comprises one or more of: a slot-shaped recess, a cross-shaped recess, a hexagonal recess and a hexagonal protrusion.

9. A kit as claimed in claim 1, wherein the second threaded element is integral with the driving formation.

10. A kit as claimed in claim 1, wherein the foot comprises a pad that is free to rotate with respect to the second threaded element.

11. A kit as claimed in claim 1, wherein the second component comprises a grip wheel located outboard of the thread of the second threaded element.

12. A kit as claimed in claim 1, wherein the sockets are positioned relative to the hole such that when the leg is attached to the base with the lugs located in the sockets the hole is aligned with the driving formation.

13. A kit as claimed in claim 1, comprising a further adjustable leg, and wherein the cabinet base defines a further set of sockets on its underside for receiving respective ones of the lugs of the further adjustable leg, the base defining no through-hole through which the driving formation of the further adjustable leg is accessible when the further adjustable leg is attached to the base with the lugs of the further adjustable leg located in the sockets of the further set.

14. A kit as claimed in claim 13, wherein the cabinet base has a front and the sockets of the further set are closer to the front than the sockets of the first set.

15. A kit as claimed in claim 1 wherein the cabinet is a kitchen cabinet.

16. A method of assembling a cabinet kit, the kit comprising a cabinet base having a hole therethrough and an adjustable leg, the adjustable leg having first and second components threadedly connected together and being configured so that a first one of the components can be engaged by a tool passing in a straight line through the other of the components for causing relative rotation of the components; the method comprising:

attaching the leg to the base in a location such that the first one of the components can be engaged by a tool passing through the hole in the base;

positioning the base in a desired installation location; and adjusting the leg by means of a tool passing through the hole, and wherein the kit is a kit as claimed in claim 1.

17. A method as claimed in claim 16, wherein the adjusting step is performed whilst the leg is engaged with a floor.

18. A kit as claimed in claim 15, wherein the cabinet includes a worktop.

19. A kit as claimed in claim 15, wherein the cabinet includes a front.

20. A kit as claimed in claim 19, wherein the front of the cabinet is fitted with a cosmetic coating.

21. A kit as claimed in claim 15, wherein the cabinet includes a plinth.

22. A kit as claimed in claim 15, wherein the cabinet includes a door.

* * * * *